United States Patent [19]

Johnson

[11] Patent Number: 4,858,252

[45] Date of Patent: Aug. 22, 1989

[54] TRIM ASSEMBLY

[75] Inventor: Dwight N. Johnson, Vista, Calif.

[73] Assignee: Masco Corporation of Indiana, Taylor, Mich.

[21] Appl. No.: 783,079

[22] Filed: Oct. 2, 1985

[51] Int. Cl.[4] ..... E03D 1/06

[52] U.S. Cl. ..... 4/368; 4/378; 137/410

[58] Field of Search ..... 4/378, 300, 324, 374, 4/375, 376, 406, 425, 428, 422, 345, 367–368, 332, 661; 137/410, 444, 216, 403, 414, 218, 217, 436, 207, 110, 336, 393; 251/44

[56] References Cited

U.S. PATENT DOCUMENTS

| | | | |
|---|---|---|---|
| 516,130 | 3/1894 | Stifel | 4/344 |
| 657,706 | 9/1900 | McGahan | 4/374 |
| 1,547,073 | 7/1925 | Smith et al. | 4/374 |
| 1,593,336 | 7/1926 | Heisele | 4/374 |
| 1,933,518 | 10/1933 | Zwermann | 4/425 |
| 1,984,394 | 12/1934 | Candee | 4/374 |
| 1,998,861 | 4/1935 | Campus | 4/422 |
| 2,006,428 | 7/1935 | Zwermann | 4/300 |
| 2,030,554 | 2/1936 | Zwermann | 4/417 |
| 2,176,578 | 10/1939 | Tower | 4/300 |
| 2,783,475 | 3/1957 | Sturman | 4/324 |
| 2,878,483 | 3/1959 | Schmid | 4/300 |
| 3,010,115 | 11/1961 | Wiggs | 4/300 |
| 3,082,433 | 3/1963 | Armstrong et al. | 4/333 |
| 3,086,217 | 4/1963 | Barlow | 4/367 |
| 3,147,762 | 9/1964 | Ducey | 137/216 |
| 3,172,128 | 3/1965 | Ducey | 4/331 |
| 3,386,459 | 6/1968 | Parkison et al. | 137/216 |
| 3,516,094 | 6/1970 | Reagan | 4/366 X |
| 3,591,868 | 7/1971 | Owens | 4/300 |
| 3,609,770 | 10/1977 | Heyer et al. | 4/368 |
| 3,969,774 | 7/1976 | Karlsson | 4/366 |
| 3,984,878 | 10/1976 | Grasseschi | 4/324 |
| 4,011,605 | 3/1977 | Karlsson et al. | 4/366 |
| 4,024,589 | 5/1977 | Klessig | 4/374 |
| 4,034,423 | 7/1977 | Milnes | 4/366 |
| 4,041,557 | 8/1977 | Ringlar | 4/300 X |
| 4,075,718 | 2/1978 | Hargraves | 4/300 |
| 4,077,602 | 3/1978 | Klessig | 4/374 X |
| 4,086,668 | 5/1978 | Tubbs | 4/425 |
| 4,318,194 | 3/1982 | Pinkston | 4/366 |
| 4,408,361 | 11/1983 | Rozek | 4/331 |
| 4,420,845 | 12/1983 | Antunez | 4/366 |

FOREIGN PATENT DOCUMENTS

| | | | |
|---|---|---|---|
| 2130941 | 1/1973 | Fed. Rep. of Germany | 4/366 |
| 2826094 | 12/1979 | Fed. Rep. of Germany | |
| 116971 | 7/1918 | United Kingdom | 4/374 |

*Primary Examiner*—Henry J. Recla
*Assistant Examiner*—J. Casimer Jacyna
*Attorney, Agent, or Firm*—Steven L. Permut; Malcolm L. Sutherland

[57] ABSTRACT

A trim assembly for a water closet is disclosed. The water closet includes a tank, a bowl, a passage communicating the tank and bowl, a plurality of rim wash ports in the bowl and a trap between the bowl and an outlet. The trim assembly includes a manifold with an inlet and first and second outlets. The first outlet is coupled to a control valve with a main valve controlling flow to a control valve chamber. The control valve chamber includes first and second outlets and pressurized fluid introduced in the control valve chamber is simultaneously communicated to these outlets. The first outlet in the valve chamber is in fluid communication with the rim wash ports and the second outlet in the valve chamber is in fluid communication with a jet ring. Flow to the first and second outlets in the valve chamber is simultaneously commenced by lifting a valve member off a pilot port in the valve chamber. The jet ring is part of a siphon flush valve that includes a standpipe mounted in the passage communicating the tank and bowl. A bell is mounted over the standpipe to define inner and an outer annular flow paths. The jet ring includes a plurality of jets for directing high pressure fluid into the outer annular flow path. A fill valve is in fluid communication with the second outlet of the manifold and fills the tank and trap after a flush cycle of the water closest is completed.

24 Claims, 8 Drawing Sheets

10
28
30
26
10
116
32
132
22
24
12
136
135
164
112
114
114
134
124
16
122
20
118
106
120
122
118
120
184
182
180
128
20
92
106
178
186
92
126
176
110
104
100
98
11
96
94

126
110
110
100
130
98
11
96
108
94
106
104
110
20
110
100
92
104
104
126
128
108
130
130
118
110
110
6
130
130
104
102
104
176
110
90
6
104
110

118
92
120
128
106
20
126
110
130
104
90
102
108
98
94
96
100
11

TRIM ASSEMBLY

BACKGROUND OF THE INVENTION

A. Field of the Invention

The present invention relates to a new and improved trim assembly for water closets that provides simultaneous rim wash with the flushing action to impart maximum kinetic energy to the flush water insuring complete flushing of the water closet.

B. Description of the Background Art

Water closets typically include a tank, a bowl, a passage between the tank and bowl, an outlet and a trap between the bowl and outlet. Normally, the tank contains water, the bowl is partly filled with water and a seal is provided between the outlet and bowl by water in the trap. A trim assembly for controlling the flushing cycle of the water closet is mounted in the tank. The trim assembly utilizes a flapper type flush valve employing a float and a drainable water cup in a pivot arm configuration to hold the flapper open when lifted, and delay closing of the flapper at the conclusion of the flush cycle.

Typical trim assemblies include a ball cock type fill valve for refilling the tank and bowl. A diverter valve is also included for supplying water to rim wash ports in the bowl. To commence a flush cycle, a trip lever on the water closet is actuated to open the flapper valve. As the tank empties, the flapper valve closes closing the diverter valve. A float and arm operate the ball cock fill valve to refill the tank and bowl. The diverter valve does not supply rim wash flow until the ball cock fill valve opens.

During a flushing cycle, water in the tank is rapidly emptied into the bowl with part of the water being directed, after a delay, to the rim wash ports. The water in the bowl empties through the trap with a siphon action. Once the flushing action is completed, the tank is refilled, and the bowl is refilled to the trap overflow level to reestablish the seal.

The typical trim assembly is prone to leakage across the flapper seat and the assembly is susceptible to failure due to binding of the several moving parts. The delay in commencement of rim wash causes interferences with good flushing action of the water closet because the staged application of flush water to the trap and rim of the water closet imparts less than optimum kinetic energy transfer to the passageway forming the trap. The kinetic energy transfer is what causes the flushing cycle to occur and if the rim wash and trap flush water could be applied simultaneously under pressure, the water closet would flush completely with less water consumption. Another disadvantage of the typical trim assembly is since the ball cock controls the flow of water to the diverter valve, the rim wash flow rate is limited to the capacity of the ball cock. The conventional float operated ball cock valve also exhibits considerable elevation of shut-off point with increases in supply pressure and requires field adjustment of water level shut-off point for proper fixture operation.

It would be desirable to provide a trim assembly that applies rim wash pressure simultaneously with flush valve operation to provide optimal energy transfer to the bowl and trap water at the beginning of the flush cycle. A trim assembly with no moving parts such as a flapper valve thereby eliminating leak paths across seating members is also desirable. The conventional trim assembly requires adjustments to the ball cock and diverter valve for proper fixture operation under different supply pressures. A trim assembly capable of consistent operation over a wide range of inlet or supply pressures would overcome the need for these adjustments and would allow easier installation.

SUMMARY OF THE INVENTION

An object of the present invention is to provide a new and improved trim assembly.

Another object of the present invention is to provide a new and improved method of flushing a water closet.

Still another object of the present invention is to provide a new and improved trim assembly that simultaneously applies rim wash pressure with flush valve operation to provide optimal energy transfer to a water closet bowl at the beginning of a flush cycle.

A further object of the present invention is to provide a new and improved trim assembly for a water closet that does not require a flapper valve thereby eliminating a source of water leakage.

A still further object of the present invention is to provide a new and improved trim assembly for a water closet capable of consistent operation over a wide range of inlet pressures without the need for adjustment.

Briefly, the present invention is directed to a new and improved trim assembly for a water closet. Water closets include a tank, a bowl, a passage communicating the bowl and tank, rim wash ports in the bowl, an outlet and a trap between the bowl and outlet. The trim assembly controls the flushing cycle of the water closet and is mounted in the tank. The assembly of the present invention provides simultaneous rim wash and commencement of the flush valve operation maximizing the transfer of kinetic energy to the trap.

The trim assembly includes a manifold that directs fluid under pressure in parallel flow relation to a control valve and to a fill valve. The control valve includes a main valve for controlling simultaneous communication of pressurized fluid in parallel flow relation to a rim wash assembly and a siphon flush valve. The flush valve uses siphon action and eliminates the moving parts in prior art trim assemblies such as the flapper valve. To provide siphon action, the flush valve employs a stand pipe mounted in the passage communicating the tank and bowl. A bell is mounted over the stand pipe to define an inner annular flow path and an outer annular flow path. A jet ring with a plurality of jets directed into the outer annular flow path toward the inner annular flow path is mounted on the bell.

To commence a flushing cycle, the main valve is actuated directing pressurized fluid to the rim wash assembly and to the jet ring. Rim wash in the bowl commences immediately and jets of water from the jet ring impart kinetic energy to fluid in the inner annular path. Transfer of kinetic energy moves water in the outer annular path over a barrier defined by the stand pipe to the inner annular flow path and into the passage between the tank and bowl. This action commences the flushing operation.

Closing of the main valve is controlled by a float and float rod. As the water level in the tank is lowered during the flushing cycle, the main valve is closed terminating fluid flow through the rim wash assembly and flush valve. Flow through the stand pipe to the bowl is terminated when the level of water in the tank drops below the bottom of the bell allowing air to break the siphon action. At approximately the same time, the fill valve is actuated by the decreasing level water in the tank and commences filling the tank and the trap.

BRIEF DESCRIPTION OF THE DRAWINGS

The above and other objects and advantages of the invention may be best understood from the following detailed description of the embodiment of the present invention illustrated in the drawings, wherein:

FIG. 8 is a view taken along line 8—8 of FIG. 7;

FIG. 18 is an exploded view of the manifold, control valve and rim wash assembly included in the trim assembly of the present invention;

DETAILED DESCRIPTION OF THE PREFERRED EMBODIMENT

Figure 1:
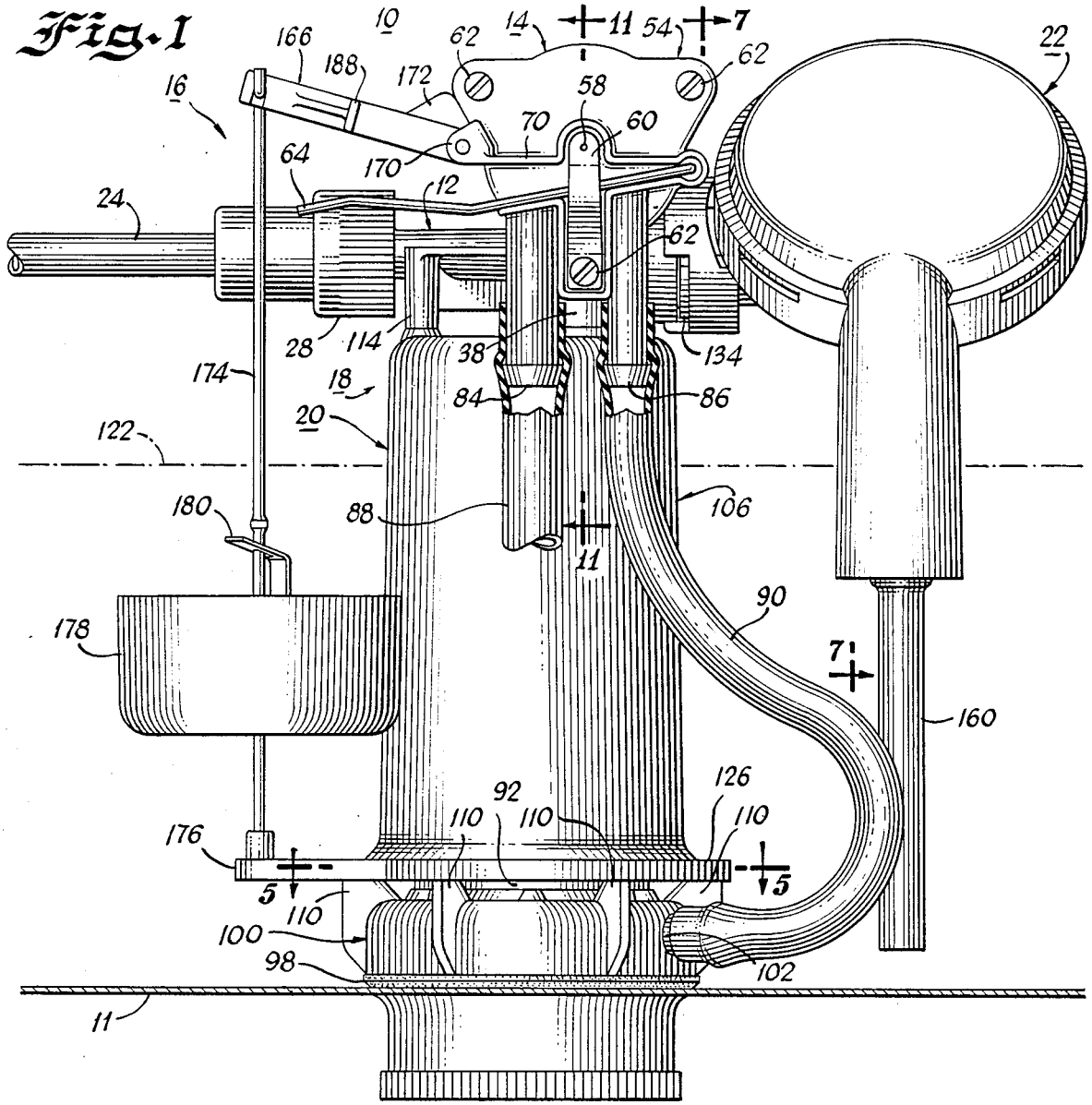
FIG. 1 is a front, elevational view of a trim assembly constructed in accordance with the principles of the present invention.
Figure 2:
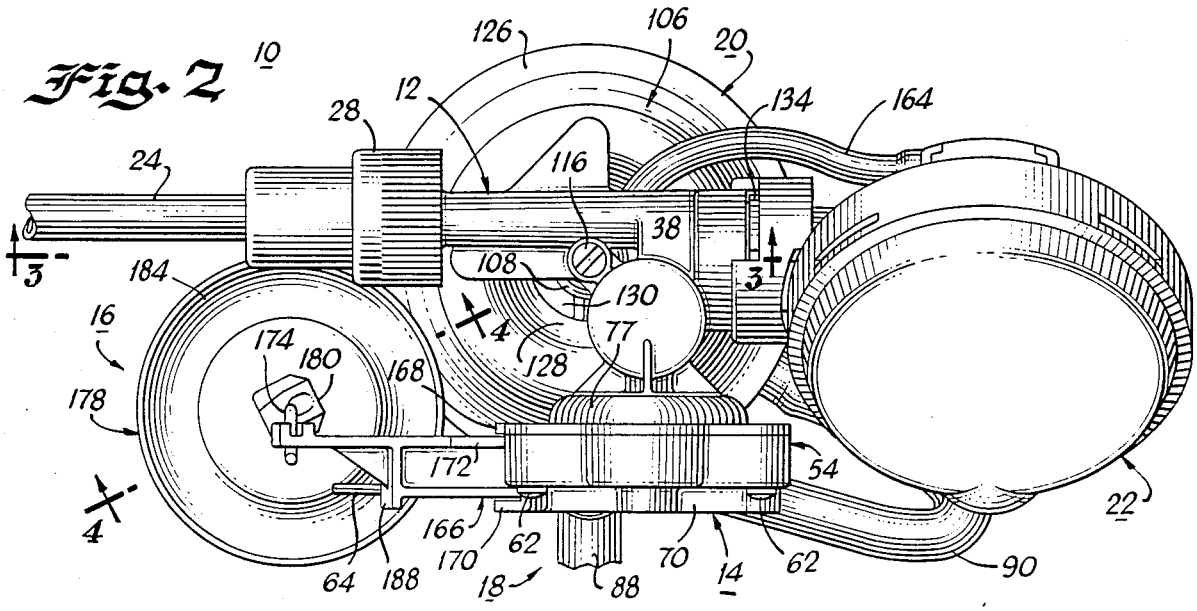
FIG. 2 is a top elevational view of the trim assembly illustrated in FIG. 1.

Referring to the drawings, there is illustrated a trim assembly generally designated by the reference numeral 10. Trim assembly 10 controls the flush cycle of a water closet. Typical water closets include a tank 11, a bowl, a passage communicating the tank and bowl, rim wash ports in the bowl, an outlet and a trap between the outlet and bowl. Trim assembly 10 differs from prior art trim assemblies in that moving parts such as a flapper valve are not required and rim wash pressure is immediately applied with flush valve operation providing optimal energy transfer to bowl and trap water at the beginning of the flush cycle. Simultaneous occurrence of rim wash pressure and flush valve operation results in maximum kinetic energy transfer to the trap. Kinetic energy causes the flushing cycle to occur and by maximizing transfer of this energy, the water closet will flush completely with less water consumption.

Trim assembly 10 mounts in the bottom of the tank 11 of a water closet and consists of four components or parts. The first component is a manifold 12. Manifold 12 is connected to a source of pressurized fluid such as a water line and functions to direct pressurized fluid or water to different components of the trim assembly 10. Manifold 12 insures consistent operation of trim assembly 10 with inlet pressures ranging from 20 psi to 80 psi without the adjustments necessary in prior art assemblies.

One of the components manifold 12 directs pressurized water to is a control valve 14, the second component of trim assembly 10. Control valve 14 controls the flow of pressurized water to commence and terminate rim wash flow and flush valve flow. Actuation of control valve 14 is accomplished by the user of the water closet by pivoting a trip lever. Closing control valve 14 is accomplished by a float and rod assembly generally designated by the reference numeral 16 in response to the level of water in tank 11 dropping to an adjustable, predetermined level.

Upon actuation, control valve 14 directs pressurized fluid to a rim wash assembly generally designated by the reference numeral 18. From rim wash assembly 18 fluid is simultaneously directed to the rim wash ports and a siphon flush valve generally designated by the reference numeral 20. Siphon flush valve 20 is the third component of trim assembly 10 and it functions to commence the flush cycle in the water closet bowl simultaneously with rim wash flow. The simultaneous commencement of rim wash and flush cycle maximizes the kinetic energy of the flush water. Siphon flush valve 20 includes no moving parts such as a flapper valve thereby eliminating the leak paths across seating members in prior art trim assemblies.

Manifold 12 also directs pressurized fluid to a fill valve 22, the fourth component of the trim assembly 10. Once fluid level in the tank 11 of the water closet drops to a predetermined level during flushing, fill valve 22 is actuated and commences to fill the tank 11, bowl and trap of the water closet. Fill valve 22 is removably attached to manifold 12 providing an integral trim assembly 10.

Figures 3, 4, 5, 6:
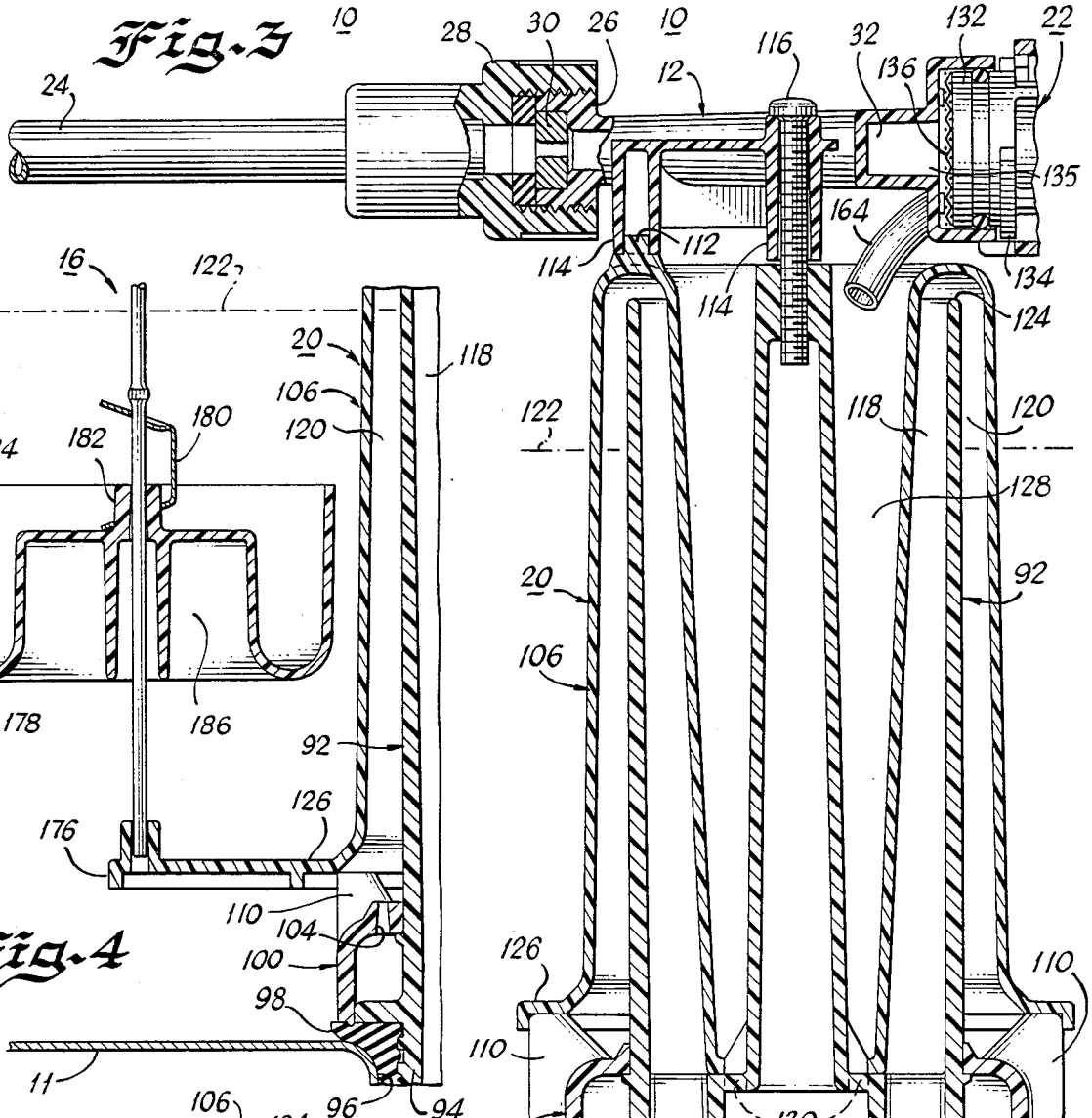
FIG. 3 is a view taken along line 3—3 of FIG. 2.
FIG. 4 is a view taken along line 4—4 of FIG. 2.
FIG. 5 is a view taken along line 5—5 of FIG. 1.
FIG. 6 is a view taken along line 6—6 of FIG. 5.
Figure 9:
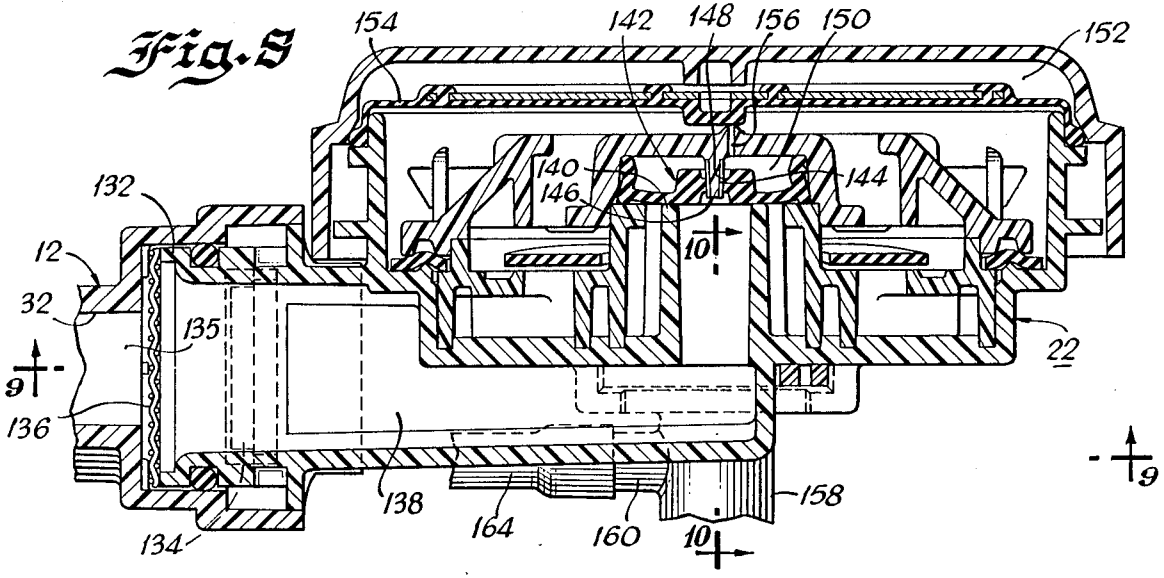
FIG. 9 is a view taken along line 9—9 of FIG. 8.
Figure 9:
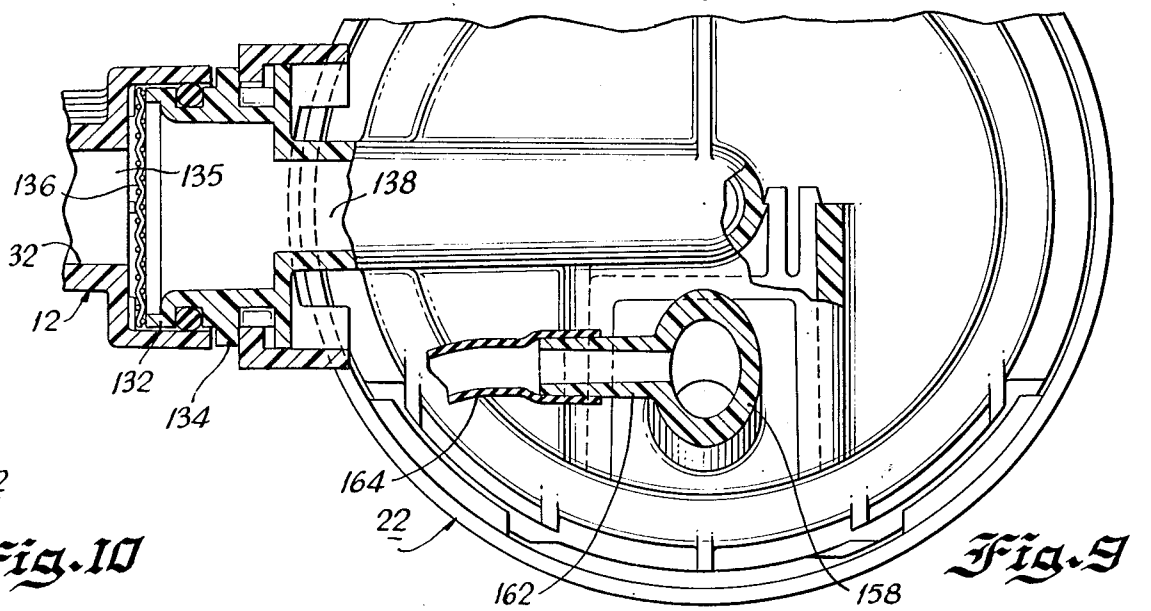
Figure 7:
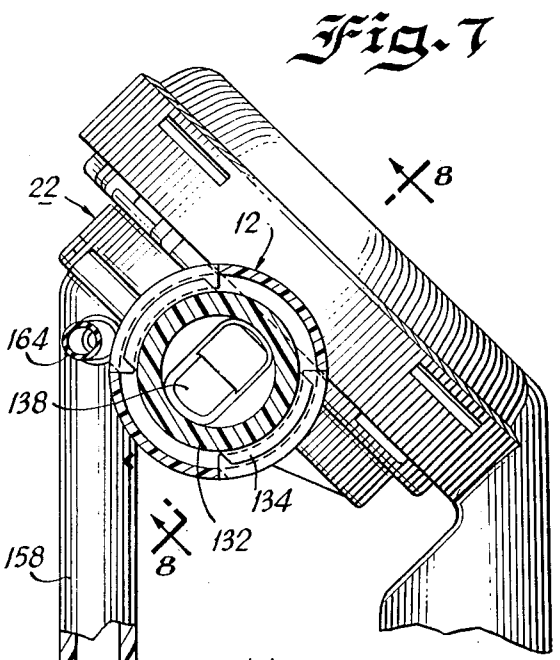
FIG. 7 is a view of the fill valve of the present invention taken along line 7—7 of FIG. 1.
Figure 10:
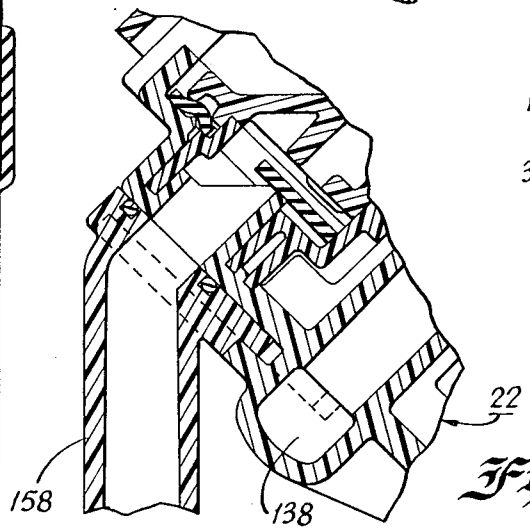
FIG. 10 is a view taken along line 10—10 of FIG. 9.

The various features of the components of trim assembly 10 are best understood by tracing the path of pressurized fluid through trim assembly 10. Trim assembly 10 is coupled to a source of pressurized fluid through an inlet line 24. Inlet line 24 may be the water line in a home or office. Inlet line 24 is threadably connected to a threaded, integral manifold supply boss 26 by a threaded coupling nut 28 (FIG. 3). Manifold supply boss 26 is counterbored to accept an elastomeric flow control 30. Flow control 30 provides a generally constant flow rate to manifold 12 over a wide range of inlet pressures thereby insuring consistent operation of the trim assembly 10 without the need for adjustment to accommodate different supply water pressures.

Figure 11:
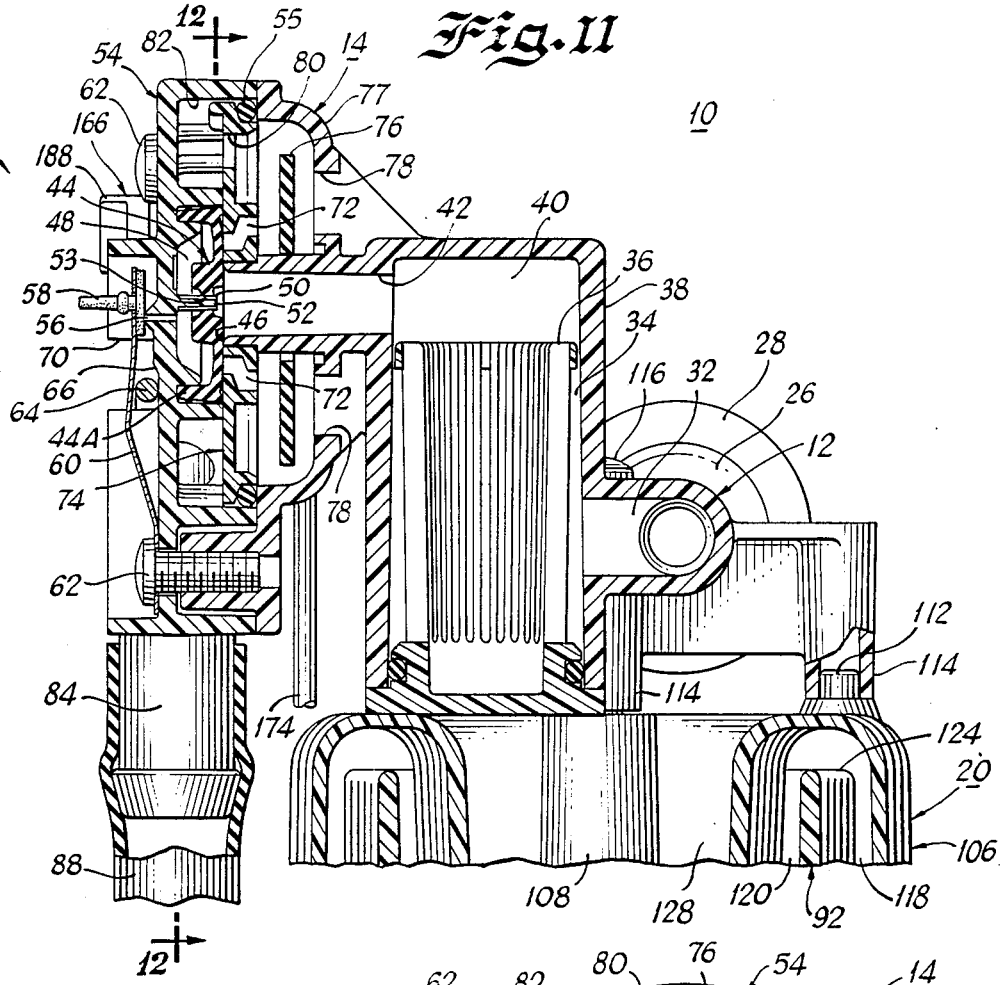
FIG. 11 is a view taken along line 11—11 of FIG. 1.
Figure 12:
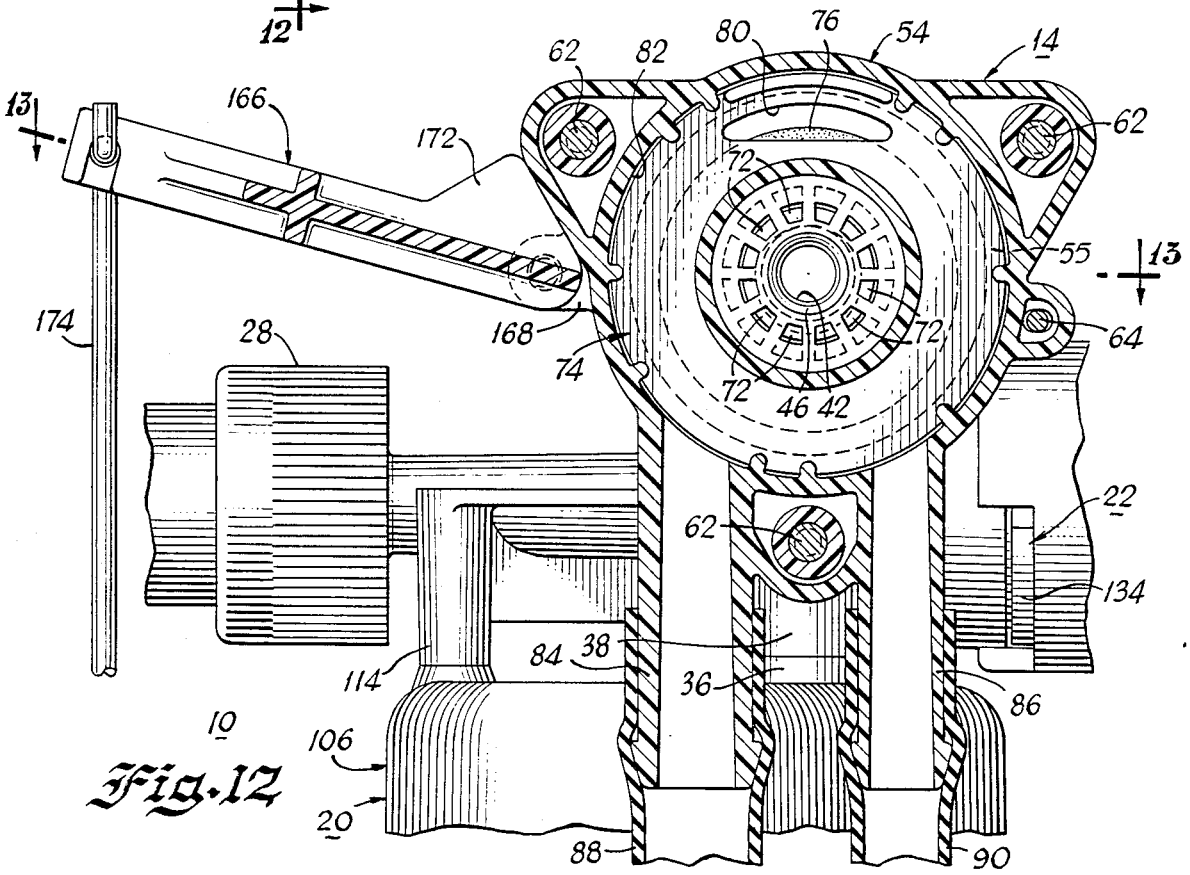
FIG. 12 is a view taken along line 12—12 of FIG. 11.
Figure 13:
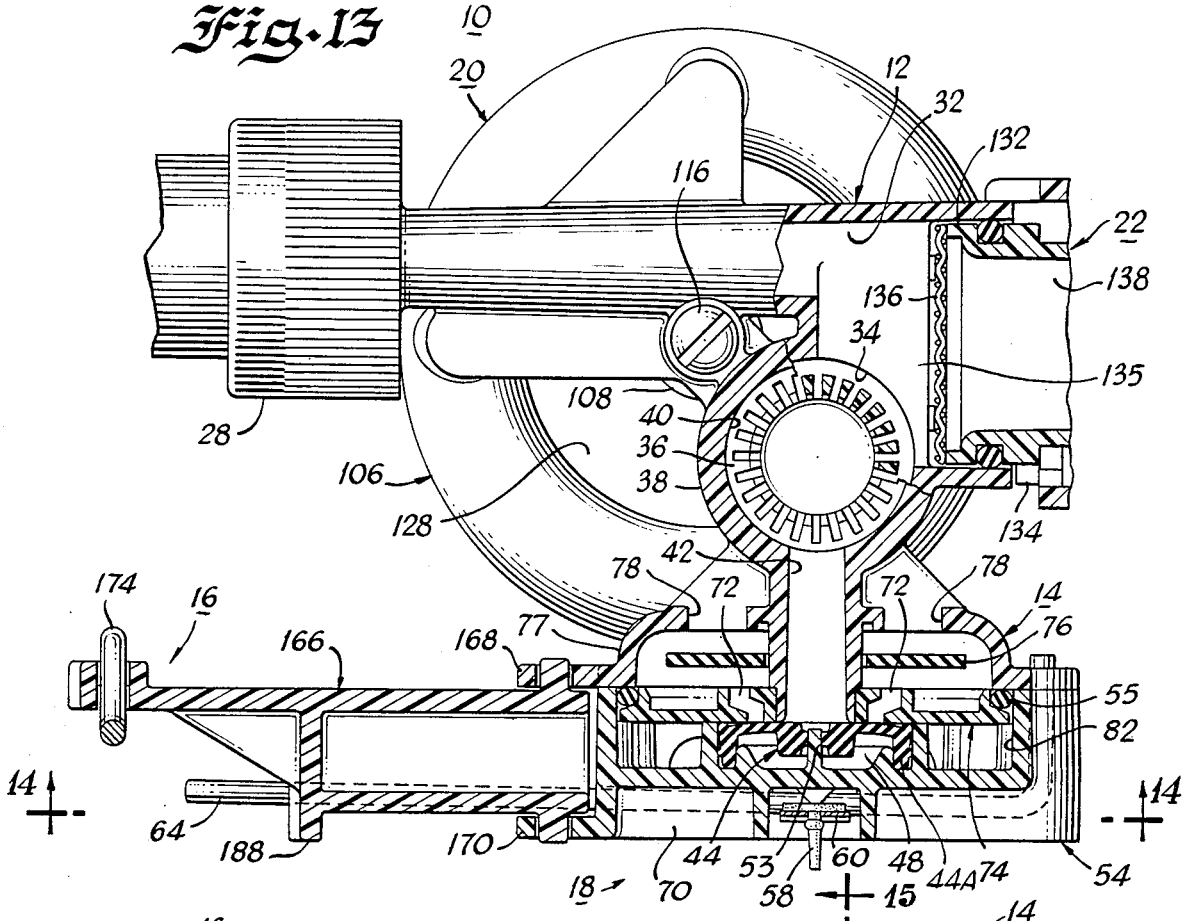
FIG. 13 is a view taken along line 13—13 of FIG. 12.

Manifold 12 includes an internal cavity 32 (FIG. 11) in unobstructed communication with the source of pressurized fluid. Cavity 32 is in communication with a vertical cavity 34. A strainer cap 36 is positioned in vertical cavity 34 and provides an outside-to-inside strainer function to protect control valve 14 from large debris in the inlet fluid. Strainer cap 36 is mounted in a strainer cap housing 38 integral with manifold 12. In the upper end of strainer cap housing 38, there is provided a chamber 40 and an integral passage 42. Flow through passage 42 is controlled by control valve 14. Prior to commencement of a flush cycle, pressurized water is communicated from inlet line 24, through manifold 12 to passage 42.

Control valve 14 includes a main valve disc 44 seated on an outlet 46 of passage 42. Opening and closing of main valve disc 44 is accomplished by supply pressure in a pilot chamber 48. Supply pressure is communicated to pilot chamber 48 across main valve disc 44 through small grooves 50 in a restrictor pin 52 integrally formed on a control valve cover 54 and extending through a central aperture 53 in main valve disc 44. Grooves 50 are kept clean by wiping action of the main valve disc 44. A housing seal 55 is positioned in control valve cover 54. The main valve disc 44 includes a sealing rim 44A preventing backflow from fluid in cover 54 across the rim of main valve disc 44 and sealing the seat area of disc 44.

Figure 14:
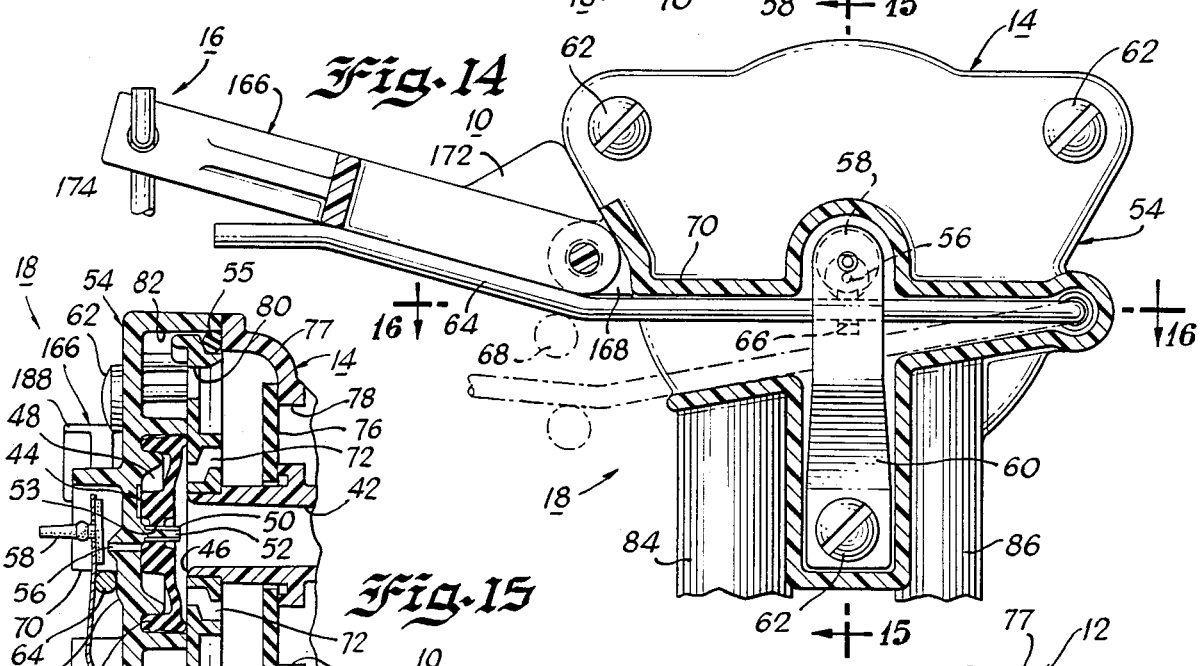
FIG. 14 is a view taken along line 14—14 of FIG. 13 with the main valve in the open position.
Figure 15:
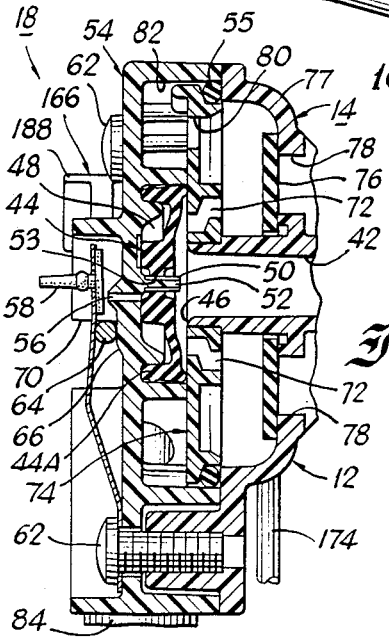
FIG. 15 is a view taken along line 15—15 of FIG. 14 with the main valve in the open position.
Figure 16:
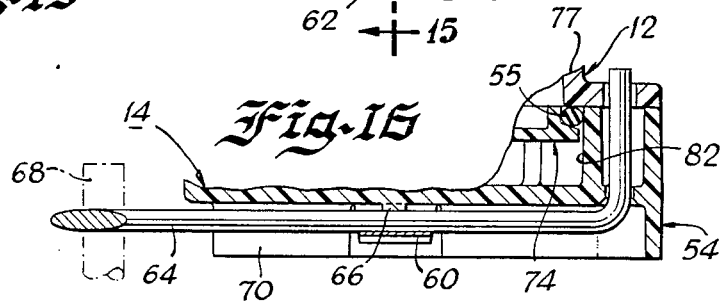
FIG. 16 is a view taken along line 16—16 of FIG. 14.
Figure 17:
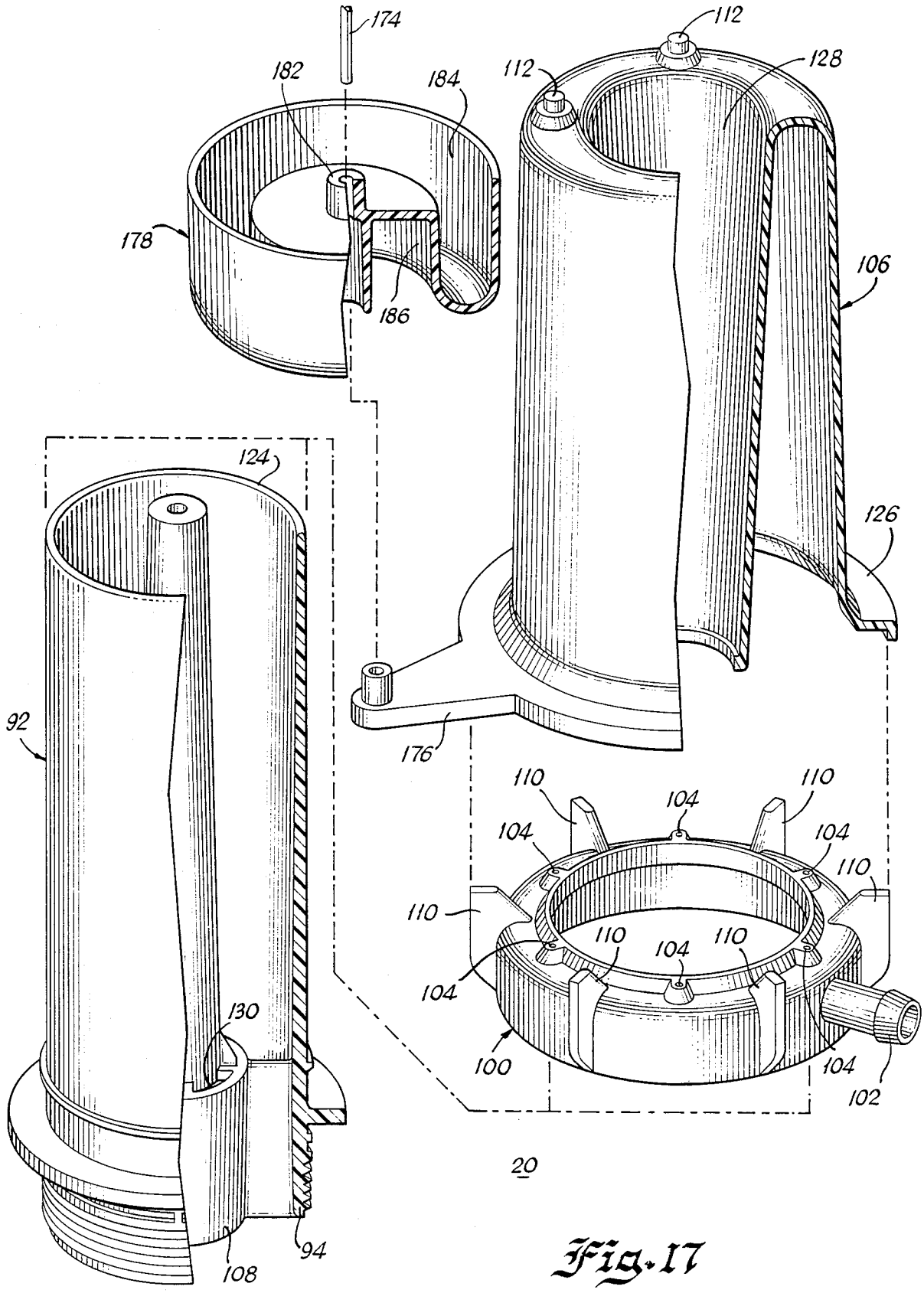
FIG. 17 is an exploded, partially cross-sectional view of the flush valve included in the trim assembly of the present invention.
Figure 19:
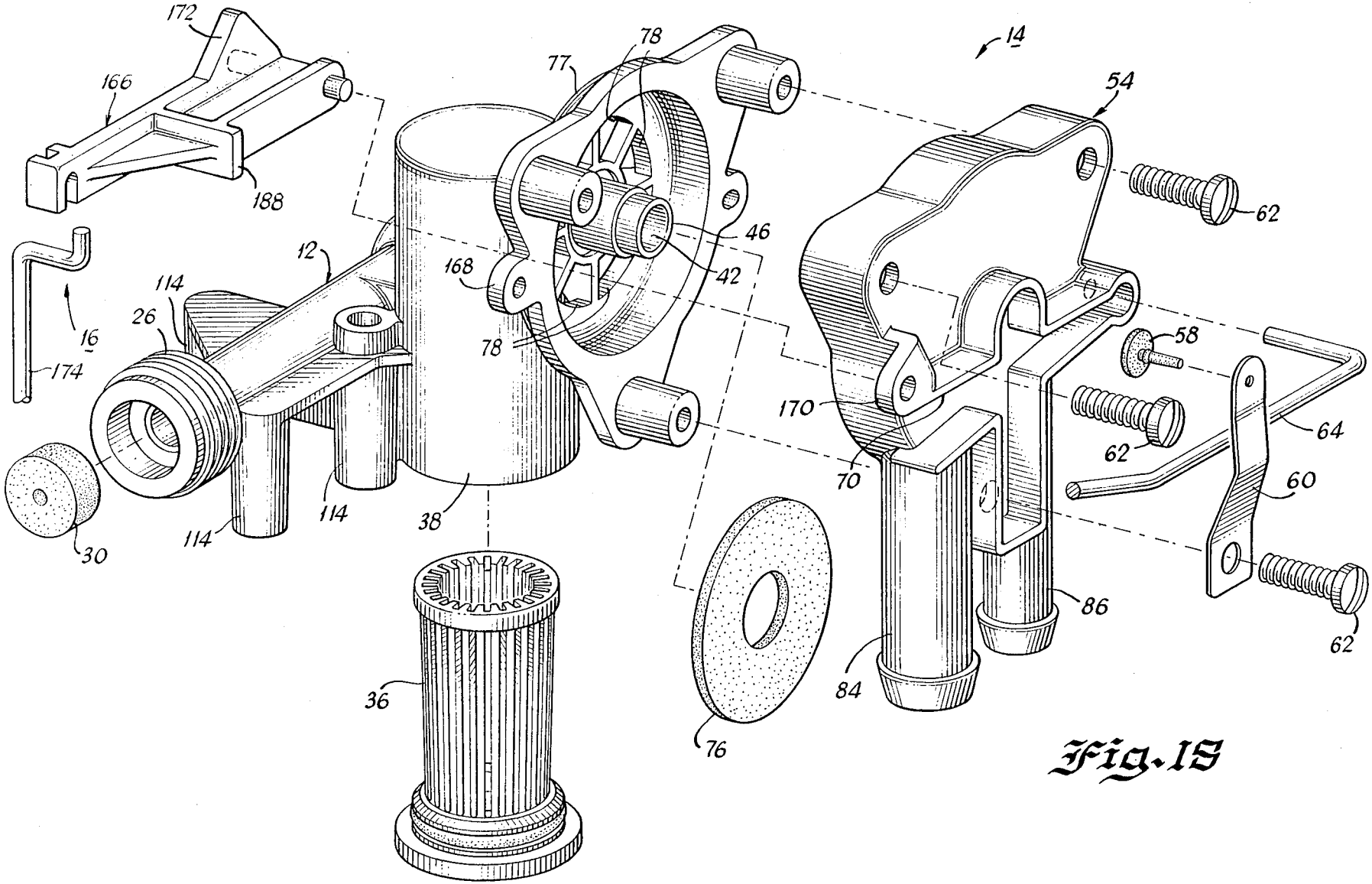
FIG. 19 is an exploded view of the rim wash assembly included in the trim assembly of the present invention.
Figure 19:
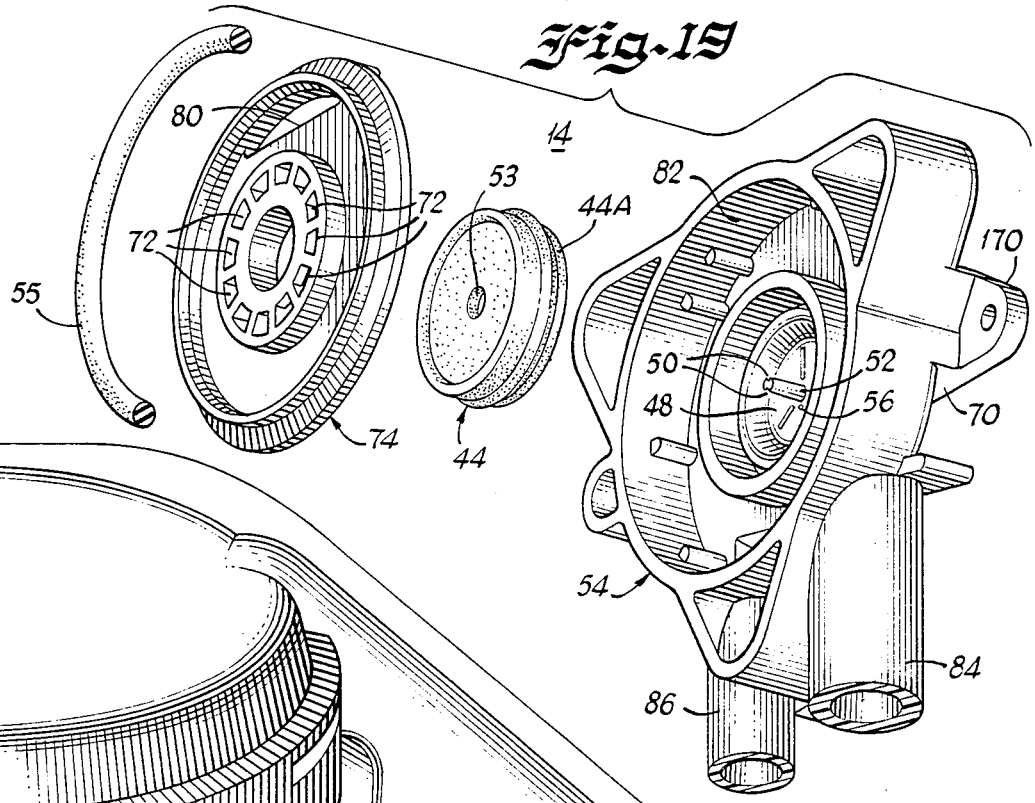
Figure 20:
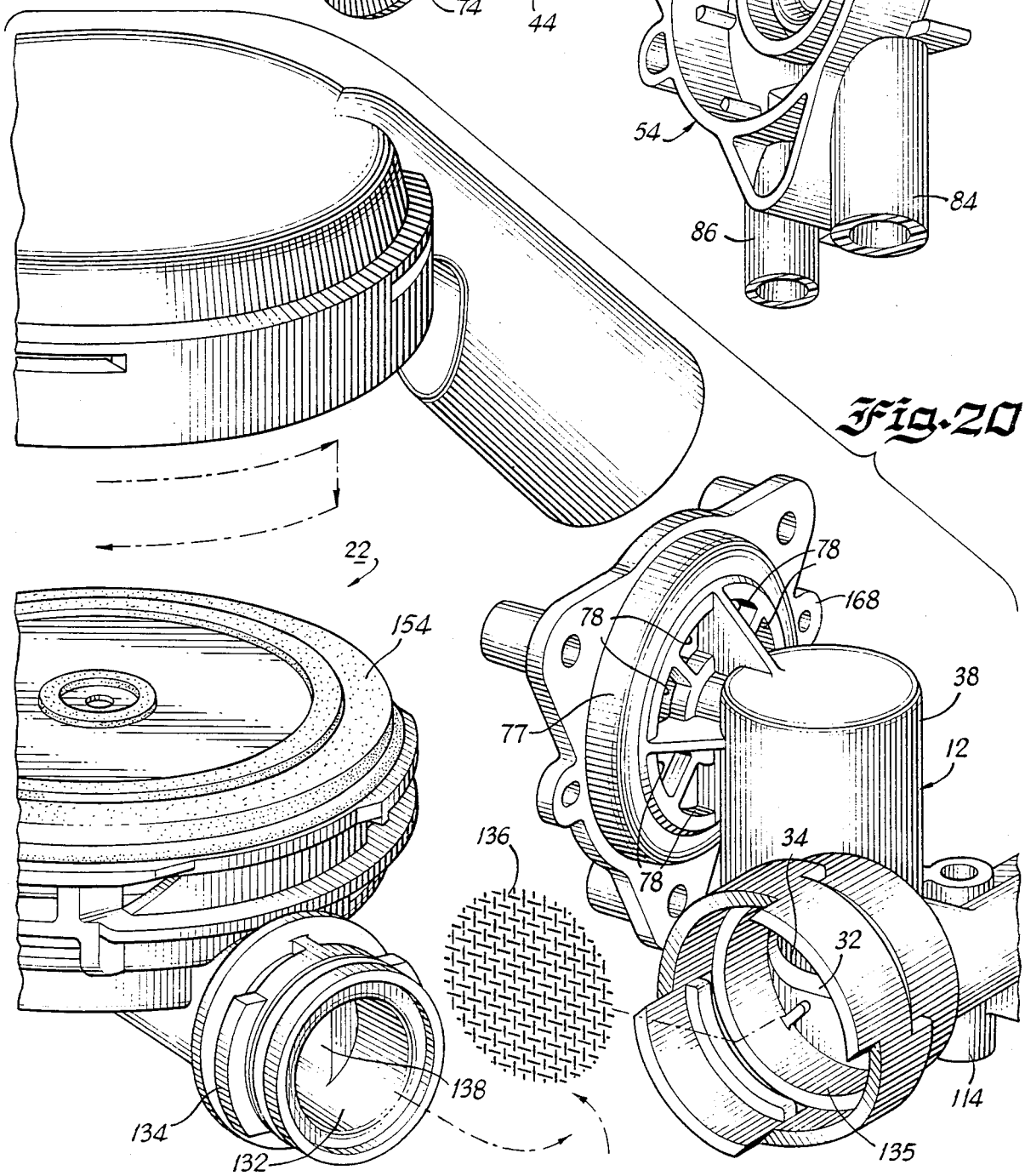
FIG. 20 is an exploded view of the fill valve included in the trim assembly of the present invention.

In the closed position of main valve disc 44 (FIG. 11), pressure in pilot chamber 48 is at supply pressure or the pressure in passage 42. Main valve disc 44 is opened or lifted off outlet 46 by venting pilot chamber 48. Pilot chamber 48 is vented through a pilot orifice 56 covered by a pilot seat member 58. Pilot seat member 58 is held in a pilot orifice seating position by a preloaded spring 60 secured to the control valve cover 54 by a fastener 62. To vent pilot chamber 48, preloaded spring 60 and pilot seat member 58 are lifted off pilot orifice 56 by a wire form or actuator 64 (FIG. 15). Wire form 64 is pivotally mounted on the control valve cover 54 allowing it to rotate approximately 10° in a clockwise direction as viewed in FIG. 14. When rotated, wire form 64 rides up a ramp 66 molded on control valve cover 54 and wedges the preloaded spring 60 and pilot seat member 58 away from the pilot orifice 56 venting pilot chamber 48 and opening main valve disc 44.

Wire form 64 is rotated when the user of the water closet pivots a trip lever 68 upward by operation of a conventional mechanism including, for example, a button or handle outside of tank 11. Trip lever 68 engages wire form 64 and rotates it clockwise as viewed in FIG. 14 commencing the flushing operation. The upper limit of travel of wire form 64 is defined by a molded flange 70 on control valve cover 54. During the flushing operation, wire form 64 is held in the upper position against control valve cover 54 by a pinching force provided by preloaded spring 60.

Once main valve disc 44 opens, fluid at supply pressure is routed through a plurality of ports 72 in a barrier plate 74. The fluid impinges on a vacuum breaker washer 76 in a vacuum breaker cover 77 driving it against a series of radially disposed atmospheric vent ports 78 and closing them. Vacuum breaker washer 76 also functions to prevent a negative pressure in the water supply from drawing water up from the rim wash and siphon flush valve 20. In the event of negative pressure, vacuum breaker washer 76 uncovers vent ports 78 venting the fluid flow path to atmosphere.

Supply fluid after impinging upon vacuum breaker washer 76 is directed to a crescent shaped opening 80 in barrier plate 74, and into an annular cavity 82 in control valve cover 54. Fluid at supply pressure collected in annular cavity 82 is simultaneously routed to a rim wash discharge tube 84 and a siphon flush valve discharge tube 86. Crescent shaped opening 80 is positioned to require approximately two and one half inches of lift above the overflow level in siphon flush valve 20 before tank water backflow can occur. This two and one half inch negative differential pressure acts on vacuum breaker washer 76 shifting it against ports 72 throttling air backflow past main valve disc 44 into the manifold 12.

Rim wash discharge tube 84 is of a larger cross sectional area than siphon flush valve discharge tube 86 resulting in a nearly constant three gallon per minute flow rate for rim wash and a one gallon per minute flow rate for the siphon flush valve 20 over a twenty to eighty psi range in supply pressure. Rim wash discharge tube 84 is communicated to the rim wash ports in the water closet bowl by a flexible vinyl tube 88 and siphon flush valve discharge tube 86 is communicated to the siphon flush valve 20 by a flexible vinyl tube 90. Due to this connection to annular cavity 82, siphon flush valve 20 is activated by the same fluid pressure as the rim wash providing optimal timing of water feed for initiation of the flush cycle.

Siphon flush valve 20 includes three parts. The first part is a standpipe 92 threaded at a lower end 94. End 94 is threaded into a threaded tank port 96 compressing a cone gasket 98. A jet ring 100 is the second part of siphon flush valve 20. Jet ring 100 encircles standpipe 92 and is mounted on cone gasket 98. Jet ring 100 includes an inlet tube 102 to which flexible tube 90 is connected. Jet ring 100 also includes a plurality of upwardly directed jets 104.

Siphon flush valve 20 further includes a bell 106, the third part, mounted over standpipe 92. Bell 106 rests on a hub 108 of standpipe 92 and a plurality of lugs 110 formed on jet ring 100. The top of bell 106 includes a plurality of integral studs 112 that securely fit into an equal number of standoffs 114 molded on manifold 12 and control valve 14 serving to align and mechanically couple together siphon flush valve 20, control valve 14 and manifold 12. A central mounting screw 116 secures the trim assembly 10 and compressively loads the bell 106 against both the standpipe hub 108 and the jet ring lugs 110.

The assembled siphon flush valve 20 defines an inner annular flow path 118 and an outer annular flow path 120 along which flush water travels during a flush cycle. Prior to the start of a flush cycle, the level of fluid in tank 11 is at dotted line 122 (FIG. 3) and in the outer annular flow path 120 is at a height approximately one inch below the top or rim 124 of standpipe 92. When supply pressure is applied to jet ring 100, jets 104 impart a high velocity fluid stream into the fluid in the outer annular flow path 120. Transfer of kinetic energy occurs between the high velocity jets and the standing fluid in outer annular flow path 120 and this transfer lifts the fluid over the standpipe rim 124 and down the inner annular flow path 118 to the tank port 96. As the fluid proceeds down the inner annular path 118, a siphon action is established that empties the fluid in the tank 11 to the point where lowering fluid uncovers the base 126 of bell 106 at which point the siphon action is broken by the admission of air to the siphon circuit.

Siphon flush valve 20 includes a central passageway 128 open at the top. Otherwise trapped air in the conduit communicating the tank and bowl is vented through ports 130 in standpipe hub 108 and through the central passageway 128. Venting this air minimizes the occurrence of bubbles in the bowl water at the beginning of the flush cycle and avoids the limiting effect of air on the boost in flush water delivery due to continued operation of the jets 104. The central passageway 128 also provides tank overflow protection in the event the tank fill valve 22 fails to shut off.

As fluid in tank 11 lowers during the early stage of the flushing cycle, the fill valve 22 is actuated. Details of the structure and operation of fill valve 22 may be obtained from application Ser. No. 536,778, filed Sept. 28, 1983, now U.S. Pat. No. 4,574,826. This application is incorporated by reference. Although specific details concerning fill valve 22 may be obtained from application Ser. No. 536,778, a brief description will be provided. Fill valve 22 includes an inlet 132 with a bayonet type lock 134 allowing fill valve 22 to be removably locked on an outlet 135 defined on manifold 12. Outlet 135 is in communication with manifold cavity 32 and since the total fluid delivery as defined by flow control 30 is limited to four gallons per minute, when fill valve 22 turns on, the flow rate to control valve 14 will reduce.

Prior to fill valve 22 turning on, fluid at supply pressure is communicated through manifold outlet 135, through a screen 136 and along inlet passage 138 to a valve seat 140 at the end of passage 138 (FIG. 8). Valve seat 140 is engaged by a main valve control member 142 and when tank 11 is full, main valve control member 142 prevents flow of fluid through fill valve 22. Main control valve member 142 is maintained in a closed position by pilot or supply pressure. Pilot fluid at supply pressure is communicated across main control valve member 142, along grooves 144 in a central projection 146 extending through a central aperture 148 in the main valve control member 142 to a pilot chamber 150. Main valve control member 142 is lifted off valve seat 140 when the fluid level in tank 11 drops to a predetermined level. When fluid drops to the predetermined level, pressure in control chamber 152 is reduced allowing diaphragm 154 to lift out of sealing engagement with a pilot port 156 venting pilot chamber 150. Main valve control member 142 lifts off valve seat 140 and fluid at supply pressure then passes through fill valve 22 to a discharge tube 158. A flexible vinyl tube 160 is connected to discharge tube 158 and extends downwardly to near the bottom of tank 11. Fluid flowing through tube 160 from fill valve 22 fills tank 11 after completion of the flush cycle.

Discharge tube 158 includes a side port 162 to which is connected a flexible vinyl tube 164. Tube 164 extends into central passageway 128 in siphon flush valve 20. Once the siphon action through siphon flush valve 20 is broken, water from tube 164 to central passageway 128 flows through tank port 96 to the bowl filling the trap with reseal water.

Late in the flush cycle as fluid in tank 11 lowers to a predetermined level, control valve 14 is shut off shutting off fluid flow to the rim wash ports and siphon flush valve 20. Fill valve 22 continues to fill the tank at the full four gallons per minute flow rate. To shut off control valve 14, float and rod assembly 16 is provided. Float and rod assembly 16 includes a lever 166 loosely mounted between a tab 168 on the vacuum breaker cover 77 and a tab 170 on the control valve cover 54. Lever 166 includes a flange 172 that engages the vacuum breaker cover 77 to define the upper limit of movement of lever 166.

A float rod 174 is attached at an upper end to lever 166. A lower end of rod 174 extends through a boss extension 176 extending from bell 106. Boss extension 176 functions as a guide for rod 174. A float cup 178 is slidably mounted on float rod 174 and is height adjustable by a spring strap 180 that engages float rod 174 and a central boss 182 of float cup 178. By compressing spring strap 180, float cup 178 may be adjusted axially on float rod 174. This adjustment in position of float cup 178 adjusts the cut-off point of the rim wash and flush valve operation since the function of the float and rod assembly 16 is to shift an actuator or wire form 64 down causing closure of the control valve 14 as the level of fluid in tank 11 is lowered.

Float cup 178 includes an upper chamber 184 and a lower chamber 186 (FIG. 3). When tank 11 is full, float cup 178 is submerged with upper chamber 184 filled with water and with air trapped in the lower chamber 186. During the flush cycle, as the level of fluid in tank 11 is dropping, the float cup 178 is exposed. As the fluid level drops to the neutral buoyancy of the float cup 178, the float cup 178 follows the level of the fluid as it continues to drop. As float cup 178 moves downward with the fluid level, the weight of the float cup 178 with fluid trapped in upper chamber 184 acts through float rod 174 to pull down lever 166. Lever 166 includes an extension 188 engaging wire form 64 during the flushing cycle (FIG. 14) and as lever 166 moves down under the weight of float cup 178, wire form 64 is pulled down ramp 66 allowing pilot seat member 58 to seat on pilot orifice 56. This causes main valve disc 44 to reseat on outlet 46 shutting off fluid at supply pressure to the rim ports and jet ring 100. The lower the position of float cup 178 on float rod 174, the longer the rim wash and jet ring 100 will operate during a flushing cycle.

After fluid to the rim ports and jet ring 100 is shut off, siphon action in flush valve 20 continues until fluid level drops below bell 106 and the entry of air breaks the siphon action. The inertia of the waste fluid in the bowl breaks the trap seal and the flushing action terminates. Fill valve 22 continues to operate filling the tank through tube 160 and filling the trap with reseal fluid through tube 164.

Trim assembly 10 when actuated, applies rim wash pressure immediately with flush valve 20 operation thereby providing optimal energy transfer to the bowl and trap fluid at the beginning of the flush cycle when it is most effective. Trim assembly 10 does not require adjustments for proper fixture operation under different supply pressures and flapper valves are eliminated in trim assembly 10 thereby eliminating a potential leak path. Trim assembly 10 is easily installed in existing water closets and the use of bayonet locks allows installation and repair with a minimum number of tools. Many parts of trim assembly 10 may be fabricated of plastic, elastomer and other non-corrosive materials insuring long life. Since trim assembly 10 includes few moving parts, the incidence of repair is significantly lower than prior art trim assemblies.

While the invention has been described with reference to details of the illustrated embodiment, it should be understood that such details are not intended to limit the scope of the invention as defined in the following claims.

What is claimed and desired to be secured by Letters Patent of the United States is:

1. The rim assembly for a water closet, said water closet including a bowl, rim wash ports in said bowl, comprising:

a manifold;

said manifold including inlet means for coupling a source of pressurized fluid to said manifold;

first passage means in said manifold;

a control valve in fluid communication with said first passage means, said control valve including an annular chamber and a valve member, controlling fluid flow from said first passage means to said annular chamber;

first and second outlets in said annular chamber;

means for connecting to said first outlet in said annular chamber to rim wash ports in said water closet;

a flush valve connected to said second outlet in said annular chamber; and said control valve including a control chamber adjacent said valve member, a pilot orifice in said control valve communicating said control chamber with ambient, a pilot valve seat member seated on said pilot orifice, and means for moving said pilot seat member off said pilot orifice.

2. The trim assembly set forth in claim 1, further comprising means for communicating pressurized fluid in said first passage means across said valve member to said control chamber.

3. The trim assembly as set forth in claim 1 wherein said moving means includes a spring mounted on said control valve and engaging said pilot valve seat member biasing said pilot seat member onto said pilot orifice, a ramp formed on said control valve adjacent said pilot orifice, and a wire form pivotally mounted on said control valve movable from a first position out of engagement with said spring to a second position engaging said spring and lifting said pilot valve seat member from said pilot orifice.

4. The trim assembly set forth in claim 1 wherein said pilot valve seat member moving means includes a float rod pivotally mounted on said control valve and a float cup adjustably mounted on said float rod.

5. The trim assembly for a water closet, said water closet including a bowl, rim wash ports in said bowl, comprising:

a manifold;

said manifold including inlet means for coupling a source of pressurized fluid to said manifold;

first passage means in said manifold;

a control valve in fluid communication with said first passage means, said control valve including an annular chamber and a valve member controlling fluid flow from said first passage means to said annular chamber;

first and second outlets in said annular chamber;

means for connecting to said first outlet in said annular chamber to rim wash ports in said water closet;

a flush valve connected to said second outlet in said annular chamber;

said flush valve including a standpipe, a bell positioned over said standpipe, said bell and said standpipe defining an outer annular flow path and an inner annular flow path, a jet ring mounted on said bell including a plurality of jets for directing pressurized fluid into said outer annular flow path, means for communicating said second outlet in said annular chamber and said jet ring and for controlling the rate of flow therethrough.

6. The trim assembly set forth in claim 5 wherein said bell and said standpipe each include an end open to ambient.

7. A trim assembly for a water closet wherein said water closet includes a bowl, a water tank, a passage between said bowl and said tank, a trap in said bowl, and rim wash ports in said bowl, said trim assembly comprising:

a flush valve mounted in said tank, said flush valve including a standpipe secured in said passage, a bell mounted over said standpipe, said bell and said standpipe define an inner annular flow path and an outer annular flow path, said inner annular flow path in communication with said passage, a jet ring secured to said standpipe, said jet ring including a plurality of jets in communication with said outer annular path, and means for directing high pressure fluid to said jet ring.

8. The trim assembly claimed in claim 7 further comprising a fill valve secured to said high pressure fluid directing means, said fill valve including a passage with an inlet in communication with said high pressure fluid directing means and a valve in said passage controlling fluid flow through said passage.

9. The trim assembly claimed in claim 7 wherein said high pressure fluid directing means includes a manifold mounted on said flush valve, said manifold including an inlet, a passage in fluid communication with said inlet, a valve member in said passage controlling fluid flow therethrough into a valve chamber, first and second outlets in said valve chamber, first means for connecting said first outlet with said rim wash ports, and second means for connecting said second outlet with said jet ring.

10. The trim assembly claimed in claim 9 wherein said first outlet is of a larger cross sectional area than said second outlet.

11. The trim assembly claimed in claim 9 further comprising means for communicating fluid pressure across said valve member to said valve chamber.

12. The trim assembly claimed in claim 9 wherein said fill valve further comprises an outlet for filling said tank, said outlet including means for filling said trap.

13. The trim assembly claimed in claim 9 further comprising a pilot port in said valve chamber, a pilot valve member seated on said pilot port, and means for lifting said pilot valve member off said pilot port, said lifting means including a spring biasing said pilot valve member onto said pilot port and a wire form movably mounted on said manifold between said pilot valve member and said pilot port.

14. The trim assembly claimed in claim 13 further comprising a lever adjacent said wire form and a float cup adjustably positioned on said lever.

15. A trim assembly for a water closet wherein said water closet includes a tank, a bowl, a passage connecting said bowl and tank, an outlet, rim flow ports in said bowl, and a trap between said bowl and said outlet, said trim assembly comprising:

a manifold, said manifold including an inlet, a first passage and a second passage, a control valve coupled to said first passage of said manifold, said control valve including a valve chamber in communication with said first passage in said manifold, a main valve element in said valve chamber controlling flow through said control valve, means for opening and closing said main valve, first and second outlets in said control valve chamber, means for communicating said first outlet with said rim flow ports, a flush valve mechanically coupled to said manifold and said control valve, said flush valve including a standpipe with means for mounting said standpipe in said passage connecting said bowl and said tank, a bell mounted over said standpipe defining an inner annular flow path and an outer annular flow path, a jet ring mounted on said bell, said jet ring including a plurality of jets directed into said outer annular flow path, means for communicating said second outlet in said control valve chamber with said jet ring, and a fill valve, means for removably connecting said fill valve to said second passage in said manifold, means for controlling fluid flow from said manifold through said fill valve, means for communicating a first portion of fluid flowing through said fill valve to said tank, means for communicating a second portion of said fluid flowing through said fill valve to said trap.

16. The trim assembly set forth in claim 15 wherein said main valve element opening and closing means includes a pilot chamber in said control valve, means for communicating pressure across said main valve element to said pilot chamber, a pilot port in said pilot chamber, a pilot valve member positioned on said pilot port, and means for moving said pilot valve member off of said pilot port, said moving means includes a spring on said pilot valve member adjacent said control valve, a wire form pivotally mounted on said control valve between said spring and said control valve, a lever pivotally mounted on said control valve at a location to engage said wire form, a float on said lever, and means for adjustably positioning said float relative to said lever.

17. The trim assembly set forth in claim 15 wherein said first outlet in said control valve chamber is of a larger cross sectional area than said second outlet in said control valve chamber.

18. The trim assembly set forth in claim 15 further comprising a flow controller in said inlet of said manifold.

19. A method of simultaneously applying rim wash with flush valve operation in a water closet wherein said water closet includes a tank, a bowl, a passage communicating said tank and said bowl, rim wash ports in said bowl, a trap in said bowl, and a tubular barrier in said tank with a bell mounted about said barrier, the steps comprising:

communicating pressurized fluid to said rim wash ports, and simultaneously imparting kinetic energy to fluid in said tank provided by pressurized fluid flowing through a plurality of jets circumferentially spaced about said tubular barrier and directing said pressurized fluid into an outer annular flow path interposed between said tubular barrier and said bell to move said fluid over said tubular barrier and into an inner annular flow path interposed between said tubular barrier and said bell to said passage creating a siphon action.

20. The method set forth in claim 19 further comprising the step of terminating the communication of said pressurized fluid to said rim ports and simultaneously terminating the imparting of kinetic energy upon the level of fluid dropping below a predetermined level in said tank.

21. The method set forth in claim 19 further comprising the step of controlling the flow rate of fluid to said rim ports and fluid used in imparting said kinetic energy.

22. The method set forth in claim 19 further comprising step of filling said tank when the level of fluid in said tank drops below a predetermined level.

23. The method set forth in claim 19 further comprising the step of filling said trap with fluid through said bowl.

24. The method set forth in claim 19 further comprising the step of breaking said siphon action by introducing air in said fluid passing over said tubular barrier upon the level of said fluid dropping below a predetermined level.

* * * * *